US008758150B1

(12) United States Patent
Parker

(10) Patent No.: US 8,758,150 B1
(45) Date of Patent: Jun. 24, 2014

(54) A-LIGNSIE GOLF TRAINING AID

(71) Applicant: Simply Play Better LLC, Lake Worth, FL (US)

(72) Inventor: Mark L. Parker, Lake Worth, FL (US)

(73) Assignee: Simply Play Better LLC, Lake Worth, FL (US)

( * ) Notice: Subject to any disclaimer, the term of this patent is extended or adjusted under 35 U.S.C. 154(b) by 0 days.

(21) Appl. No.: 14/083,107

(22) Filed: Nov. 18, 2013

Related U.S. Application Data

(60) Provisional application No. 61/736,038, filed on Dec. 12, 2012.

(51) Int. Cl.
*A63B 69/36* (2006.01)

(52) U.S. Cl.
CPC ..... *A63B 69/3667* (2013.01)
USPC ..... 473/218; 473/266; 473/278

(58) Field of Classification Search
USPC ..... 473/218, 219, 231, 238, 257, 266, 270
See application file for complete search history.

(56) References Cited

U.S. PATENT DOCUMENTS

| | | | | | |
|---|---|---|---|---|---|
| 4,000,905 | A | * | 1/1977 | Shirhall | 473/218 |
| 4,101,130 | A | * | 7/1978 | Richards | 473/270 |
| D252,048 | S | * | 6/1979 | Richards | D21/792 |
| 4,434,983 | A | * | 3/1984 | Taggart | 473/273 |
| 5,131,659 | A | * | 7/1992 | Lindberg, Jr. | 473/267 |
| 5,306,011 | A | * | 4/1994 | Perry | 473/218 |
| 5,348,304 | A | * | 9/1994 | Meade | 473/409 |
| 5,362,060 | A | | 11/1994 | Hinson | |
| 5,417,428 | A | * | 5/1995 | Warren | 473/218 |
| 5,464,220 | A | * | 11/1995 | Hansen et al. | 473/218 |
| 6,592,376 | B1 | * | 7/2003 | Carpenter | 434/252 |
| 6,726,576 | B1 | | 4/2004 | Froggatte | |
| 6,932,712 | B2 | * | 8/2005 | Cardosi | 473/261 |
| 7,607,987 | B2 | | 10/2009 | Alter | |
| 7,927,227 | B2 | | 4/2011 | Radcliffe et al. | |
| 8,066,580 | B2 | * | 11/2011 | Conway | 473/218 |

* cited by examiner

*Primary Examiner* — Nini Legesse

(74) *Attorney, Agent, or Firm* — Nicholas Pfeifer; Smith & Hopen, P.A.

(57) ABSTRACT

The present invention is a golf training aid designed to completely and effectively instruct a golfer how to setup for a successful golf shot. The golf training aid includes a substrate having a predetermined geometrical shape, preferably rectangular, having visual indices, preferably imprinted on a top surface of the substrate, to aid the golfer in addressing a golf ball or setting up to execute a golf shot. The visual indices include a plurality of club head/ball alignment indices, a hand alignment indicator, a feet alignment indicator, an eye alignment indicator, a stance width indicator, and a directional indicator.

20 Claims, 4 Drawing Sheets

A-LIGNSIE GOLF TRAINING AID

CROSS-REFERENCE TO RELATED APPLICATIONS

This nonprovisional application claims priority to U.S. provisional application No. 61/736,038, entitled "Eye-a-lign Golf Training Aid," filed Dec. 12, 2012 by the same inventor, the contents of which are hereby incorporated by reference.

BACKGROUND OF THE INVENTION

1. Field of the Invention

This invention relates, generally, to golf. More specifically, it relates to golf training aids.

2. Brief Description of the Prior Art

Over the past decade, golf has been declining in popularity. Many speculate that the decline is linked to the difficulty of the game. There are numerous factors affecting one's ability to succeed at the game. Arguably, the most important aspect is a golfer's pre-swing setup. Golfing great Jack Nicklaus has been quoted saying "if you set up correctly, there's a good chance you'll hit a reasonable shot, even if you make a mediocre swing. If you set up to the ball poorly, you'll hit a lousy shot even if you make the greatest swing in the world."

Ideally, a perfect pre-swing setup allows for proper posture, foot placement, ball position, and body alignment. Proper posture and foot placement improve balance while ball position and body alignment improve control. A golfer's setup directly influences the golfer's swing dynamics, which is why it is so important to develop a correct pre-swing setup.

Currently, the available golf training aids are complex, difficult to use, indiscreet, and exclusive to certain alignments. Accordingly, what is needed is simple and discreet golf setup training device providing instruction for proper feet alignment with the target, appropriate stance width, correct posture, and appropriate ball location with respect to the type of golf club being used. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a simple and discreet golf setup training device providing complete and effective instructions for addressing a golf ball or setting up to execute a golf shot is now met by a new, useful, and nonobvious invention.

The novel structure includes a substrate of a predetermined geometric shape, preferably a generally rectangular shape, having a plurality of visual indices. The substrate has a predetermined height, width, and length such that the substrate has a front side, rear side, left hand side, right hand side, top surface, and bottom surface. The plurality of visual indices, preferably imprinted on the top surface of the substrate, aid a user in addressing a golf ball prior to executing a golf shot.

The plurality of visual indices includes a plurality of club head/ball alignment indices, a hand alignment indicator, a feet alignment indicator, an eye alignment indicator, a directional indicator, and a stance width indicator. The plurality of club head alignment indices includes at least a driver alignment indicator, a mid-iron alignment indicator, and a short iron alignment indicator. Both the hand alignment indicator and the feet alignment indicator are preferably comprised of the substrate side closest to the user's body, whereas the eye alignment indicator is preferably comprised of the side of the substrate furthest from the user's body. The directional indicator is parallel to at least the feet alignment indicator. The stance width indicator includes the rear side of the substrate being a location for the user's rear foot instep and the front side of the substrate being a location for the user's front foot instep.

The size of the substrate and the relative locations of the plurality of visual indices provide a golfer with a complete and effective means to properly and consistently address a golf ball before executing a golf shot.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
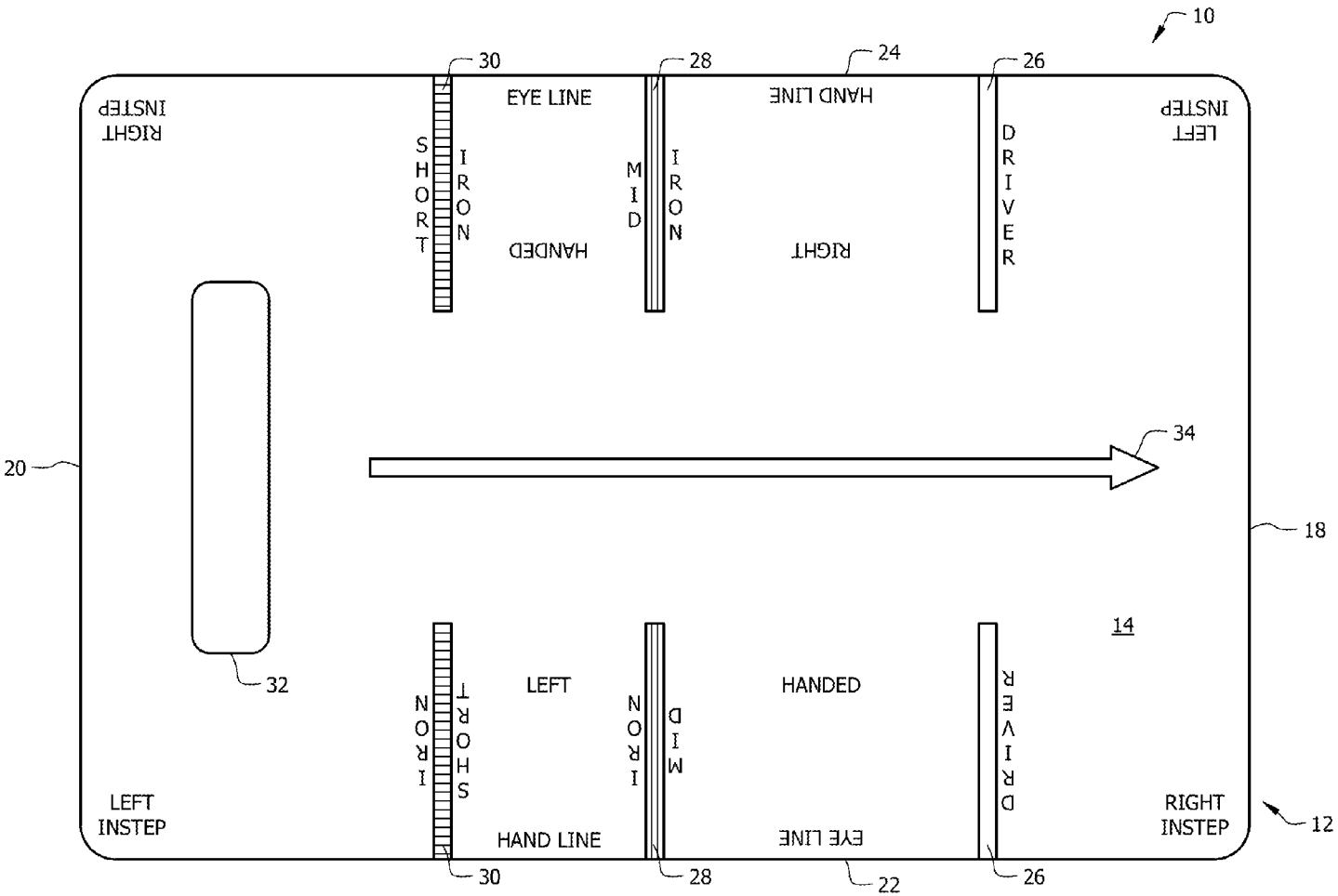
FIG. 1 is a top view of the golf training aid.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a golf training aid designed to completely and effectively instruct a golfer how to setup for a successful golf shot. The golf training aid includes a substrate having a predetermined geometrical shape, preferably rectangular, containing visual indices, preferably imprinted on a top surface of the substrate, to aid the golfer in addressing a golf ball before executing a golf shot. The visual indices include a plurality of club head/ball alignment indices, a hand alignment indicator, a feet alignment indicator, an eye alignment indicator, a stance width indicator, and a directional indicator.

The plurality of club head/ball alignment indices include at least a driver, a mid-iron, and a short iron indicator. Mid-irons typically include irons 5-8 and short irons typically include a 9 iron, pitching wedge, gap wedge, sand wedge and lob wedge. The loft of golf club faces typically increase from driver to long irons and from long irons to short irons. When using a driver, a golfer intends to hit a golf ball a long distance, which requires a greater launch angle and less spin on the golf ball. Both requirements can be met by striking the ball when the club head has a slightly positive angle of attack. In other words, the golfer wants to make contact with the golf ball when his/her club head has just passed the lowest point in the club's swing arc and is on the up slope of the swing. In order to accomplish such an impact, the golf ball should be forward in the golfer's stance, towards the instep of the golfer's front foot.

When using mid-irons a typical golfer should have the ball located closer to the middle of his/her stance. When the ball is located closer to the middle of the stance, the club is more likely to strike the ball about four inches prior to the lowest point of the swing. This aids in hitting higher trajectory shots and allows for maximum club head speed upon impact.

When using short irons a typical golfer should have the ball located slightly back from the center of his/her stance, where back is the direction away from the intended golf ball flight direction. These higher lofted clubs, are used to produce higher and softer shots. The likelihood of producing such a shot is increased when the ball position is slightly back of center. When the golf ball is further back in the stance, the club head strikes the ball on more of a downward angle, which results in the club head compressing the ball. This compression creates backspin on the golf ball in turn creating more lift and proper ball flight. Higher flight and more back spin help limit the distance of the golf ball's continued forward travel after landing, which is ideal for shorter shots intending for the golf ball to land and remain on the green.

The hand alignment indicator and the feet alignment indicator are comprised of the side of the substrate which is closest to the user. A golfer's toe alignment is typically a correct indication of the golfer's aim, therefore it is crucial to develop a feel for proper feet alignment with the target. The feet alignment indicator is parallel to the directional indicator, running preferably along the longitudinal axis of the substrate, and provides a user with the required toe alignment to accomplish correct targeting of the user's desired golf shot. The same side of the substrate that makes up the feet alignment indicator is preferably also the hand alignment indicator. A golfer's arms should hang in a roughly vertical orientation. With proper posture the roughly vertical arm orientation would result in a golfer's hands being located at the golfer's toe line. Golfers often over extend their hands from their bodies resulting in improper posture and swing plane, producing poor golf shots. When a golfer's hands are located along the toe line, there is a significant improvement in the possibility of making a proper swing and a well-executed golf shot.

The eye alignment indicator is the side of the substrate opposite the hand and feet alignment indicators. The eye alignment indicator provides a golfer with a means to establish correct posture, which is necessary to execute a proper swing. A golfer should be slightly bent over towards the golf ball, pivoting from the hips, while maintaining a relatively straight or flat back position. When a golfer's eyes are extended the correct distance over towards the golf ball, the golfer is forced to bend at the hips in a relatively straight or flat back position. Without the eye alignment indicator, it would be difficult for a golfer to determine whether he/she has proper posture.

The stance width indicator is a combination of the side of the substrate facing the target (front side) and the side of the substrate facing away from the target (rear side). The sides indicate the location of the insteps of the golfer's feet such that the golfer's stance width, from instep to instep, is the width of the substrate. The substrate has a width approximately equal to the width of an average person's shoulders, which is the desired stance width for a typical golfer. A shoulder width stance provides a golfer with appropriate balance during the swing.

A certain embodiment may utilize physical indices having any form known to a person having ordinary skill in the art, including but not limited to, apertures, extending members, and an irregular outer substrate boundary.

A certain embodiment of the A-lignsie golf training aid contains an aperture, disposed on the top face of the substrate having a size and shape, known to a person having ordinary skill in the art, such that a user is provided with a handle like structure for carrying the substrate. The aperture is preferably centrally located about the longitudinal axis of the substrate and a predetermined distance from the rear side of the substrate, known by a person having ordinary skill in the art, such that the predetermined distance is an amount easily graspable when a user's fingers are inserted into the aperture.

A certain embodiment of the substrate is comprised of a durable and washable material known to a person having ordinary skill in the art. A certain embodiment may also utilize a flexible material, known to a person having ordinary skill in the art, capable of adjusting to undulating surfaces found on a golf course.

EXAMPLE

Embodiment 10, as shown in FIG. 1, includes a generally rectangular substrate generally denoted as reference numeral 12 having a predetermined length, width, and height such that substrate 12 has front side 18, rear side 20, left hand side 22, and right hand side 24. Substrate 12 has top face 14 upon which alignment indices may be printed and a bottom face, not shown, which is in contact with the ground. A certain embodiment may contain directional indicator 34 for informing a user on the proper orientation of the substrate with respect to the desired direction, exemplified as arrow 34' in FIG. 2, of the golf shot.

Figure 2:
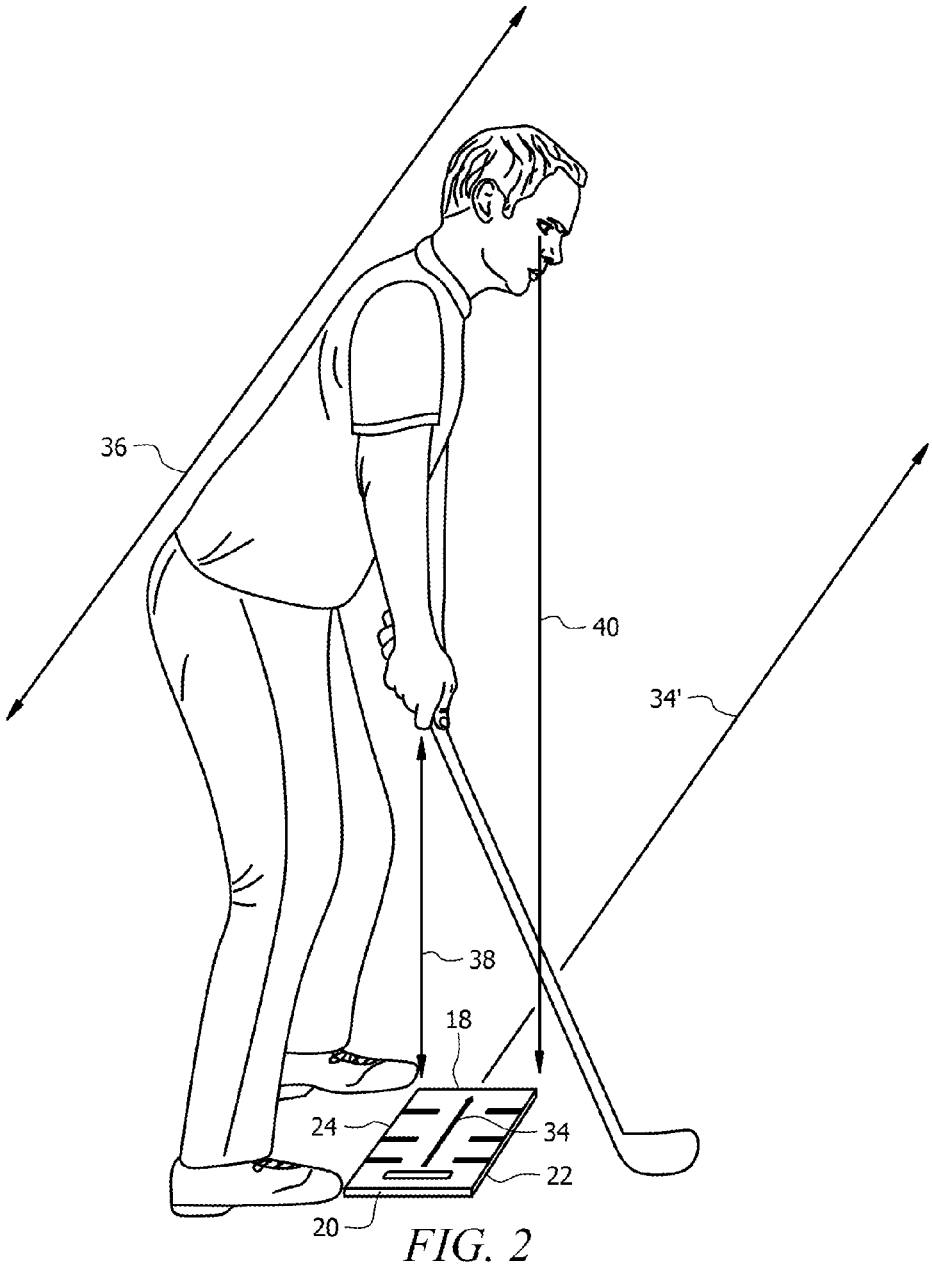
FIG. 2 is a perspective view of the golf training aid being employed by a right-handed user.

As shown in FIG. 2, substrate 12 is designed to have a length roughly equal to an average person's shoulder width. This configuration allows front side 18 and rear side 20 to act as foot location indicators. A user's front foot instep should be positioned generally at front side 18 of substrate 12 and a user's rear foot instep should be positioned generally at rear side 20 of substrate 12. When the user's insteps are located at these respective positions, the user will have a generally shoulder width stance allowing for proper balance during a golf swing. Typically, the length of substrate 12 is between about 14.5 inches and about 16.5 inches. In a preferred embodiment, substrate 12 is approximately 15.5 inches. Certain embodiments may have substrate lengths greater than 16.5 inches or less than 14.5 inches to account for persons of all ages and sex.

Right hand side 24 and left hand side 22 are straight edges allowing either a right-handed or left-handed golfer the ability to align his/her toes with the straight edge, in turn aligning the shot direction. A golfer's toe alignment is directly related to the golfer's aim and golfers often struggle to properly align their toes with the target. The straight edge of sides 22, 24 provide an easy means for correcting this frequent error and help ingrain the feel for proper alignment and aim.

Sides 22 and 24 contain an additional benefit of providing indications for hand and eye locations. Whether side 22 or side 24 is a hand or eye alignment is based on whether the golfer is a right-handed or left-handed golfer. For a right-handed golfer, right hand side 24 is located along a golfer's toe alignment, which is the proper location for a right-handed golfer's hand placement. In turn, a right-handed golfer's eye alignment becomes left hand side 22 when the golfer extends his/her head out and over his/her hands. See FIG. 2, where arrow 38 illustrates proper hand alignment and arrow 40 indicates proper eye alignment. The width of substrate 12 is typically between about 9.5 inches and about 11.5 inches, which is an appropriate distance to reduce the possibility of a golfer over extending his/her head out over his/her hands and the possibility of a golfer standing too vertically. By not over extending his/her head out over his/her hands, a golfer is more likely to have proper posture, shown by arrow 36 in FIG. 2, with minimal back arching. Such posture greatly improves a golfer's ability to execute a proper golf shot. In a preferred embodiment the width of substrate 12 is approximately 10.5 inches. Certain embodiments of substrate 12 may utilize widths being less than 9.5 inches or greater than 11.5 inches, known to a person having ordinary skill in the art, to account for persons of varying sizes, ages, or sex.

Figure 4:
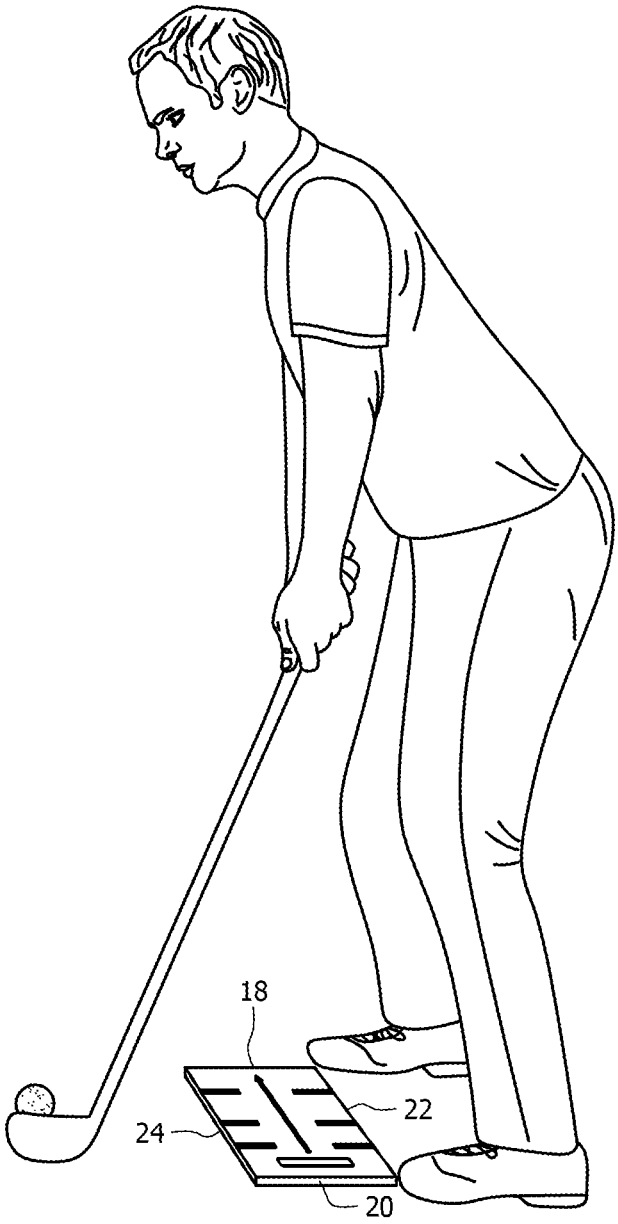
FIG. 4 is a perspective view of a left-handed user employing the golf training aid.

Similarly, for a left-handed golfer as shown in FIG. 4, left hand side 22 is located along a golfer's toe alignment and provides the golfer's hand location. Right hand side 24 then provides an indicator for the location of a golfer's eye alignment.

Figure 3:
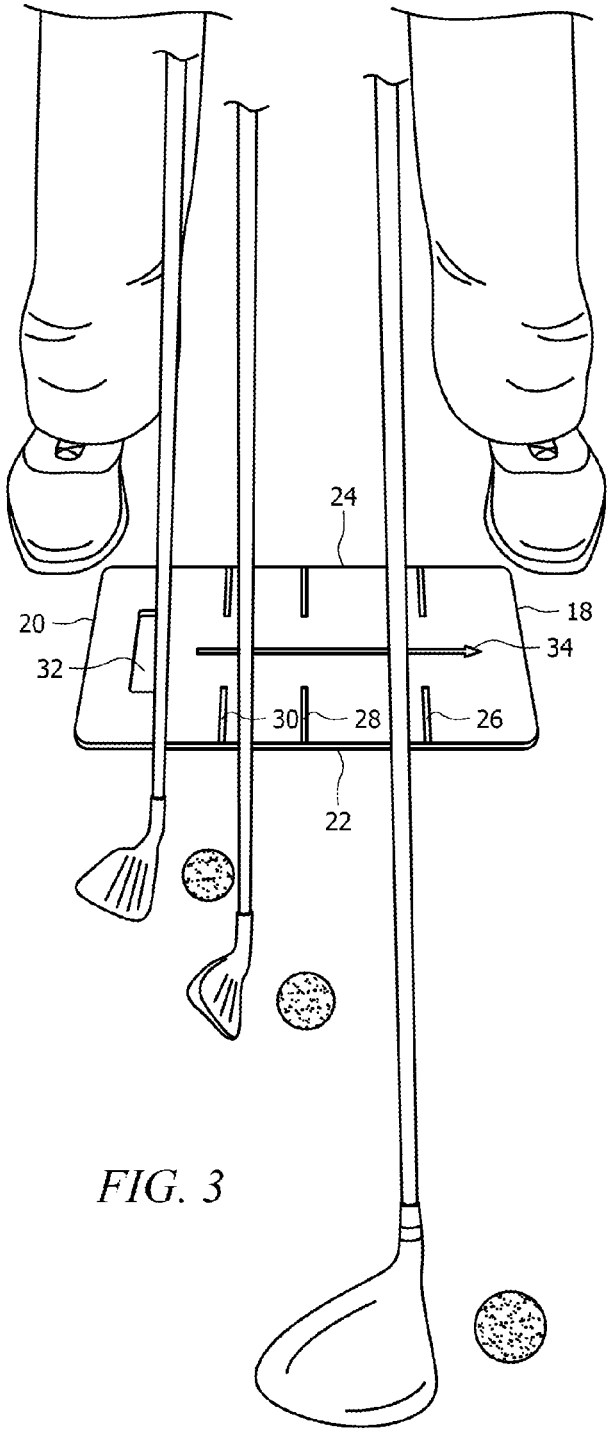
FIG. 3 is a side perspective view illustrating the various ball/club head alignment indices.

As shown in FIGS. 1 and 3, substrate 12 further includes ball/club head alignment indices 26, 28, 30 where club head alignment indication 26 provides the appropriate approximate alignment location for a driver. Indication 28 provides the approximate alignment location for mid-irons, and indication 30 is for short irons. Indices 26, 28, 30 are located on both right hand side 24 and left hand side 22 to allow both a right-handed or left-handed golfer to practice the golf training aid. The location for indication 26 is typically between about 2.5 inches and about 4.5 inches from front side 18 of substrate 12. The location for indication 28 is typically between about 7 inches and about 9 inches from front side 18 of substrate 12. The location for indication 30 is typically between about 9 and 13/16 inches and about 11 and 13/16 inches from front side 18 of substrate 12. In a preferred embodiment, indices 26, 28, 30 are respectively located at 3.5 inches, 8 inches, and 10 and 13/16 inches from front side 18 of substrate 12. Certain embodiments of substrate 12 may utilize indices 26, 28, 30 at locations being further or closer to front side 18, known to a person having ordinary skill in the art, relative to varying lengths of substrate 12.

A certain embodiment may include additional alignment indices imprinted on the substrate at a location, relative to existing indices, that is known to a person having ordinary skill in the art. Moreover, a certain embodiment may contain readable instructions imprinted on the top surface of the substrate to aid in identifying the plurality of visual indices.

A certain embodiment may utilize a substrate with an extended width, known to a person having ordinary skill in the art, such that a user could place a golf ball on the top surface of the substrate at a proper distance from the user, allowing the user to hit the golf ball off of the top surface. In such an embodiment, the top surface may contain at least some portion comprised of a material, known to a person having ordinary skill in the art, capable of enduring the effects associated with hitting a golf ball off of the surface. Such an embodiment, may also contain at least one golf tee like structure, known to a person having ordinary skill in the art, generally aligned with the club alignment indices. The at least one golf tee structure may be removable. The extended width may have two portions which extend from the left hand and right hand sides. These portions may be attachable to the original substrate with a hinging means to allow the extended width portions to fold under the substrate to a location adjoining the bottom surface of the substrate. The foldable portions allow the golf training aid to be used on any surface while maintaining the ability to be practiced by both right-handed and left-handed persons.

GLOSSARY OF CLAIM TERMS

Club Head Alignment Indices: are a set of indicators providing a user with the approximate optimal alignment, with respect to the golfer's stance, for the golf ball and club head before the swing. These indices are based on the type of club being used.

Directional indicator: is an indicator providing a user with the approximate intended direction of a golf shot when the user's toe line is aligned with the feet alignment indicator.

Driver: is a golf club typically having the longest shaft, largest head, and lowest loft in a set of golf clubs, excluding the putter.

Eye Alignment Indicator: is an indicator providing a user with the approximate optimal distance a user's head and eyes should extend outward over the user's hands.

Feet Alignment Indicator: is an indicator providing a user with the approximate optimal alignment of a user's toe line with the intended target of the golf shot.

Hand Alignment Indicator: is an indicator providing a user with the approximate optimal distance, from a user's body, for the user's hands before the swing.

Mid-Irons: are a set of golf irons typically including irons 5-8, but can also include irons 4 and 9. These irons are typically shorter and have higher loft than a driver, but lower loft and longer shafts than shot irons.

Short Irons: are a set of golf irons typically including a nine iron, pitching wedge, gap wedge, sand wedge and lob wedge, but can also include an 8 iron. These irons are typically shorter with higher loft than the mid-irons.

Stance Width Indicator: is an indicator providing a user with the approximate optimal width of a user's stance.

Substrate Bottom Surface: is a surface of the substrate that is in contact with the ground and facing towards the ground away from the user.

Substrate Front Side: is the side of the substrate that is generally facing towards the direction of the intended target.

Substrate Left Hand Side: is the side of the substrate that is on the right side of the substrate when viewed from rear side of the substrate looking towards the front side of the substrate. In other words, the left hand side is the side of the substrate where a left-handed user would align his/her hands (a left-handed user's hand alignment indicator).

Substrate Rear Side: is the side of the substrate that is generally facing away from the direction of the intended target.

Substrate Right Hand Side: is the side of the substrate that is on the left side of the substrate when viewed from rear side of the substrate looking towards the front side of the substrate. In other words, the right hand side is the side of the substrate where a right-handed user would align his/her hands (a right-handed user's hand alignment indicator).

Substrate Top Surface: is the surface of the substrate that is facing up towards a user and not in direct contact with the ground.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A golf training aid comprising:

a substrate of a predetermined geometric shape, the substrate further including:

a predetermined height, width, and length such that the substrate has a front side, a rear side, a left hand side, a right hand side, a top surface, and a bottom surface;

a central longitudinal axis extending the length of the substrate such that the axis is located an equal distance between the left hand side and right hand side of the substrate;

a plurality of visual indices to aid a user in addressing a golf ball before executing a golf shot, the plurality of visual indices consisting of:

a plurality of club head alignment indices;

a single hand alignment indicator;

a single feet alignment indicator;

a single eye alignment indicator;

a single stance width indicator, wherein the stance width indicator is a predetermined set distance between the insteps of a user's front foot and back foot; and the hand alignment indicator and the eye alignment indicator are located an equal distance from the central longitudinal axis of the substrate such that a right handed golfer's hand alignment indicator is a left handed golfer's eye alignment indicator when both users are set-up to hit a golf ball in a direction towards the front side of the substrate.

2. The golf training aid of claim 1, further comprising:

the substrate having a generally rectangular shape.

3. The golf training aid of claim 1, further comprising:

the plurality of club head alignment indices further including:

a driver alignment indicator;

a mid-iron alignment indicator; and a short iron alignment indicator.

4. The golf training aid of claim 3, further comprising:

the driver alignment indicator located a distance from the front side of the substrate, wherein the distance is between about 2.5 inches and about 4.5 inches.

5. The golf training aid of claim 3, further comprising:

the mid-iron alignment indicator located a distance from the front side of the substrate, wherein the distance is between about 7 inches and about 9 inches.

6. The golf training aid of claim 3, further comprising:

the short iron alignment indicator located a distance from the front side of the substrate, wherein the distance is between about 9 and 13/16 inches and 11 and 13/16 inches.

7. The golf training aid of claim 1, further comprising:

the plurality of club head alignment indices being located near both the right hand side of the substrate and the left hand side of the substrate.

8. The golf training aid of claim 1, further comprising:

the hand alignment indicator being the side of the substrate closest to the user's body.

9. The golf training aid of claim 1, further comprising:

the eye alignment indicator being the side of the substrate furthest from the user's body.

10. The golf training aid of claim 1, further comprising:

the stance width indicator further including:

the rear side of the substrate being an indicator for a location of the user's rear foot instep; and the front side of the substrate being an indicator for a location of user's front foot instep.

11. The golf training aid of claim 1, further comprising:

the length of the substrate being between about 14.5 inches and about 16.5 inches.

12. The golf training aid of claim 1, further comprising:

the width of the substrate being between about 9.5 inches and about 11.5 inches.

13. The golf training aid of claim 1, further comprising:

the plurality of visual indices being imprinted on the top surface of the substrate.

14. The golf training aid of claim 1, further comprising:

a directional indicator.

15. The golf training aid of claim 14, further comprising:

the directional indicator being parallel to the feet alignment indicator.

16. The golf training aid of claim 1, further comprising:

an aperture through the top and bottom surfaces of the substrate, wherein the aperture is capable of receiving at least some portion of a user's hand to provide a handle for carrying the substrate.

17. The golf training aid of claim 1, further comprising:

A plurality of alphanumeric characters imprinted on the top surface of the substrate to aid in identifying at least one of the plurality of visual indices.

18. A golf training aid comprising:

a substrate of a predetermined geometric shape, the substrate further including:

a predetermined height, width, and length such that the substrate has a front side, a rear side, a left hand side, a right hand side, a top surface, and a bottom surface;

a generally rectangular shape;

a central longitudinal axis extending the length of the substrate such that the axis is located an equal distance between the left hand side and right hand side of the substrate;

a plurality of visual indices imprinted onto the substrate to aid a user in addressing a golf ball or setting up to execute a golf shot, the plurality of visual indices further includes transversally extending indices and longitudinally extending indices;

the transversally extending indices include:

a plurality of club head alignment indices, wherein the plurality of club head alignment indices further includes a driver alignment indicator, a mid-iron alignment indicator, and a short iron alignment indicator;

a stance width indicator, wherein the stance width indicator includes a front foot instep location and a back foot instep location separated by a predetermined set distance;

the longitudinally extending indices consist of:

a single hand alignment indicator;

a single feet alignment indicator;

a single eye alignment indicator; and the hand alignment indicator and the eye alignment indicator are located an equal distance from the central longitudinal axis of the substrate such that a right handed golfer's hand alignment indicator is a left handed golfer's eye alignment indicator when both users are set-up to hit a golf ball in a direction towards the front side of the substrate.

19. A golf training aid comprising:

a substrate of a predetermined geometric shape, the substrate further including:

a predetermined height, width, and length such that the substrate has a front side, a rear side, a left hand side, a right hand side, a top surface, and a bottom surface;

a central longitudinal axis extending the length of the substrate such that the axis is located an equal distance between the left hand side and right hand side of the substrate;

a plurality of visual indices to aid a user of a predetermined height in addressing a golf ball before executing a golf shot, wherein the plurality of visual indices includes:

a plurality of club head alignment indices;

a single hand alignment indicator extending longitudinally with the substrate;

a single feet alignment indicator extending longitudinally with the substrate;

a single eye alignment indicator extending longitudinally with the substrate and located at a predetermined distance from the single hand alignment indicator, wherein the predetermined distance is based on the height of the intended user;

a single stance width indicator, wherein the stance width indicator is a predetermined set distance based on the height of the user to fit between the insteps of a user's front foot and back foot; and the hand alignment indicator and the eye alignment indicator are located an equal distance from the central longitudinal axis of the substrate such that a right handed golfer's hand alignment indicator is a left handed golfer's eye alignment indicator when both users are set-up to hit a golf ball in a direction towards the front side of the substrate.

20. The golf training aid of claim 19, wherein the length of the substrate is between about 14.5 inches and about 16.5 inches and the width of the substrate is between about 9.5 inches and about 11.5 inches.

* * * * *